US009394797B2

(12) United States Patent
Mukhopadhyay et al.

(10) Patent No.: US 9,394,797 B2
(45) Date of Patent: Jul. 19, 2016

(54) TURBOMACHINE NOZZLE HAVING FLUID CONDUIT AND RELATED TURBOMACHINE

(71) Applicant: General Electric Company, Schenectady, NY (US)

(72) Inventors: Debabrata Mukhopadhyay, Bangalore (IN); Steven Sebastian Burdgick, Schenectady, NY (US); Prashant Prabhakar Sankolli, Bangalore (IN); Moorthi Subramaniyan, Bangalore (IN)

(73) Assignee: General Electric Company, Schenectady, NY (US)

( * ) Notice: Subject to any disclaimer, the term of this patent is extended or adjusted under 35 U.S.C. 154(b) by 881 days.

(21) Appl. No.: 13/693,610

(22) Filed: Dec. 4, 2012

(65) Prior Publication Data

US 2014/0154066 A1 Jun. 5, 2014

(51) Int. Cl.

| | |
|---|---|
| ***F01D 9/02*** | (2006.01) |
| ***F01D 5/18*** | (2006.01) |
| ***F01D 11/00*** | (2006.01) |

(52) U.S. Cl.

CPC ..... *F01D 5/187* (2013.01); *F01D 5/186* (2013.01); *F01D 9/02* (2013.01); *F01D 11/001* (2013.01); *F05D 2220/31* (2013.01); *F05D 2240/122* (2013.01)

(58) Field of Classification Search

CPC ..... F01D 9/02; F01D 9/04; F01D 9/047; F01D 9/06; F01D 9/065; F01D 11/001; F05D 2240/122; F05D 2220/31

USPC ..... 415/115, 116, 914

See application file for complete search history.

(56) References Cited

U.S. PATENT DOCUMENTS

| | | | | |
|---|---|---|---|---|
| 3,746,462 | A * | 7/1973 | Fukuda | F01D 11/10 415/115 |
| 5,328,326 | A * | 7/1994 | Gros | F01D 1/10 415/115 |
| 6,530,745 | B2 | 3/2003 | Ciani | |
| 7,422,415 | B2 * | 9/2008 | Burdgick | F01D 5/145 415/1 |
| 7,870,743 | B2 * | 1/2011 | Lee | F01D 5/189 416/96 R |
| 2010/0239412 | A1 * | 9/2010 | Draper | F01D 5/186 415/115 |
| 2010/0329853 | A1 * | 12/2010 | Guo | F01D 9/065 415/169.2 |
| 2011/0097198 | A1 * | 4/2011 | Sanchez | F01D 5/145 415/168.2 |

FOREIGN PATENT DOCUMENTS

GB 1013835 A * 12/1965

* cited by examiner

*Primary Examiner* — Ninh H Nguyen
*Assistant Examiner* — Jesse Prager
(74) *Attorney, Agent, or Firm* — Ernest G. Cusick; Hoffman Warnick LLC

(57) ABSTRACT

Various embodiments include a steam turbine nozzle and turbomachinery including such a nozzle. In various particular embodiments, a steam turbine nozzle includes: a body having: a first sidewall and a second sidewall opposite the first sidewall; a pressure side and a suction side each extending between the first sidewall and the second sidewall; and a leading edge section at a first junction of the pressure side and the suction side, and a trailing edge section at a second junction of the pressure side and the suction side; and a bypass fluid conduit including: a channel having an opening to at least one of the first sidewall or the second sidewall; and an outlet passageway fluidly connected with the channel between the first sidewall and the second sidewall, the outlet passageway including a first opening on at least one of the pressure side of the body, the suction side of the body or the trailing edge section.

6 Claims, 3 Drawing Sheets

TURBOMACHINE NOZZLE HAVING FLUID CONDUIT AND RELATED TURBOMACHINE

FIELD OF THE INVENTION

The subject matter disclosed herein relates to power systems. More particularly, the subject matter relates to turbomachine systems.

BACKGROUND OF THE INVENTION

Conventional turbomachines (also referred to as turbines), such as steam turbines (or, steam turbomachines), generally include static nozzle assemblies that direct the flow of working fluid (e.g., steam) into rotating buckets that are connected to a rotor. In steam turbines the nozzle (or, airfoil) construction is typically called a "diaphragm" or "nozzle assembly" stage. Nozzle assemblies are assembled in two halves around the rotor, creating a horizontal joint.

Conventionally, steam turbines also include packings (or, seals) at the root of the nozzle and the tip of the rotating bucket. These packings are used to reduce axial leakage across the interface between the nozzle and rotor body, and bucket and stator diaphragm, respectively. The leakage in these areas can disturb the flow of working fluid (e.g., steam) prior to introduction of that fluid to the buckets, causing performance losses.

BRIEF DESCRIPTION OF THE INVENTION

Various embodiments include a steam turbine nozzle and turbomachinery including such a nozzle. In various particular embodiments, a steam turbine nozzle includes: a body having: a first sidewall and a second sidewall opposite the first sidewall; a pressure side and a suction side each extending between the first sidewall and the second sidewall; and a leading edge section at a first junction of the pressure side and the suction side, and a trailing edge section at a second junction of the pressure side and the suction side; and a bypass fluid conduit including: a channel having an opening to at least one of the first sidewall or the second sidewall; and an outlet passageway fluidly connected with the channel between the first sidewall and the second sidewall, the outlet passageway including a first opening on at least one of the pressure side of the body, the suction side of the body or the trailing edge section.

A first aspect of the invention includes a steam turbine nozzle having: a body including: a first sidewall and a second sidewall opposite the first sidewall; a pressure side and a suction side each extending between the first sidewall and the second sidewall; and a leading edge section at a first junction of the pressure side and the suction side, and a trailing edge section at a second junction of the pressure side and the suction side; and a bypass fluid conduit including: a channel having an opening to at least one of the first sidewall or the second sidewall; and an outlet passageway fluidly connected with the channel between the first sidewall and the second sidewall, the outlet passageway including a first opening on at least one of the pressure side of the body, the suction side of the body or the trailing edge section.

A second aspect of the invention includes a turbomachine diaphragm including: an inner diaphragm ring; an outer diaphragm ring radially outward of the inner diaphragm ring; and a set of static nozzles spanning between the inner diaphragm ring and the outer diaphragm ring, wherein at least one static nozzle in the set of static nozzles includes: a body having: a first sidewall and a second sidewall opposite the first sidewall; a pressure side and a suction side each extending between the first sidewall and the second sidewall; and a leading edge section at a first junction of the pressure side and the suction side, and a trailing edge section at a second junction of the pressure side and the suction side; and a bypass fluid conduit including: a channel having an opening to at least one of the first sidewall or the second sidewall; and an outlet passageway fluidly connected with the channel between the first sidewall and the second sidewall, the outlet passageway including a first opening on at least one of the pressure side of the body, the suction side of the body or the trailing edge section.

A third aspect of the invention includes a turbomachine having: a rotor section; and a stator section substantially housing the rotor section, the stator section including: a packing section; and a set of static nozzles spanning between an inner diaphragm ring and an outer diaphragm ring, wherein at least one static nozzle in the set of static nozzles includes: a body having: a first sidewall and a second sidewall opposite the first sidewall; and a pressure side and a suction side each extending between the first sidewall and the second sidewall; and a bypass fluid conduit including: a channel having an opening to at least one of the first sidewall or the second sidewall proximate the packing section; and an outlet passageway fluidly connected with the channel between the first sidewall and the second sidewall, the outlet passageway including a first opening on the pressure side of the body, wherein the bypass fluid conduit is configured to divert a fluid from the packing section to the first opening on the pressure side of the body during operation of the turbomachine.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
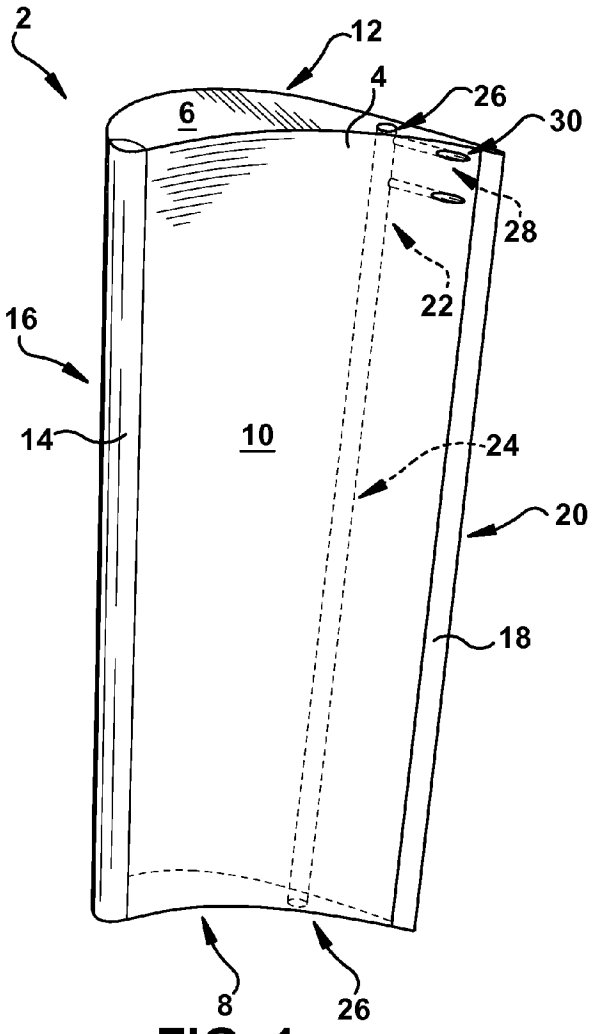
FIG. 1 shows a schematic three-dimensional perspective view of a turbomachine nozzle from its pressure side according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to power systems. More particularly, the subject matter relates to turbomachine systems.

As described herein, conventional steam turbines include packings (or, seals) at the root of the nozzle and the tip of the rotating bucket. These packings are used to reduce axial leakage across the interface between the nozzle and rotor body, and bucket and stator diaphragm, respectively. The leakage in these areas can disturb the flow of working fluid (e.g., steam), especially where that leakage flow re-enters the main steam flow downstream of the nozzle prior to reaching the bucket. This disturbance can cause performance losses.

In contrast to conventional turbomachines (e.g., steam turbines), various embodiments of the invention include at least one static nozzle having a bypass fluid conduit extending there-through, which diverts flow of fluid, e.g., leakage fluid, from the packing (seal) proximate the static nozzle and to the pressure side of the static nozzle. Once the diverted fluid reaches the pressure side of the static nozzle, it is introduced into the main (or, primary) steam flow path and can perform mechanical work in the turbomachine.

Various particular embodiments of the invention include a steam turbine nozzle. The nozzle can include: a body including: a first sidewall and a second sidewall opposite the first sidewall; a pressure side and a suction side each extending between the first sidewall and the second sidewall, the pressure side and the suction side; and a leading edge section at a first junction of the pressure side and the suction side, and a trailing edge section at a second junction of the pressure side and the suction side; and a bypass fluid conduit having: a channel having an opening to at least one of the first sidewall or the second sidewall; and an outlet passageway fluidly connected with the channel between the first sidewall and the second sidewall, the outlet passageway including a first opening on at least one of the pressure side of the body, the suction side of the body or the trailing edge section.

Various other particular embodiments of the invention include a turbomachine diaphragm (e.g., a steam turbine). The diaphragm can include: an inner diaphragm ring; an outer diaphragm ring radially outward of the inner diaphragm ring; and a set of static nozzles spanning between the inner diaphragm ring and the outer diaphragm ring, wherein at least one static nozzle in the set of static nozzles includes: a body having: a first sidewall and a second sidewall opposite the first sidewall; a pressure side and a suction side each extending between the first sidewall and the second sidewall, the pressure side and the suction side; and a leading edge section at a first junction of the pressure side and the suction side, and a trailing edge section at a second junction of the pressure side and the suction side; and a bypass fluid conduit having: a channel having an opening to at least one of the first sidewall or the second sidewall; and an outlet passageway fluidly connected with the channel between the first sidewall and the second sidewall, the outlet passageway including a first opening on at least one of the pressure side of the body, the suction side of the body or the trailing edge section.

Various additional particular embodiments of the invention include a turbomachine (e.g., a steam turbine). The turbomachine can include: a rotor section; and a stator section substantially housing the rotor section, the stator section including: a packing section; and a set of static nozzles spanning between an inner diaphragm ring and an outer diaphragm ring, wherein at least one static nozzle in the set of static nozzles includes: a body having: a first sidewall and a second sidewall opposite the first sidewall; and a pressure side and a suction side each extending between the first sidewall and the second sidewall, the pressure side and the suction side; and a bypass fluid conduit having: a channel having an opening to at least one of the first sidewall or the second sidewall proximate the packing section; and an outlet passageway fluidly connected with the channel between the first sidewall and the second sidewall, the outlet passageway including a first opening on the pressure side of the body, wherein the bypass fluid conduit is configured to divert a fluid from the packing section to the first opening on the pressure side of the body during operation of the turbomachine.

As used herein, the terms "axial" and/or "axially" refer to the relative position/direction of objects along axis A, which is substantially perpendicular to the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (C) which surrounds axis A but does not intersect the axis A at any location.

Figure 2:
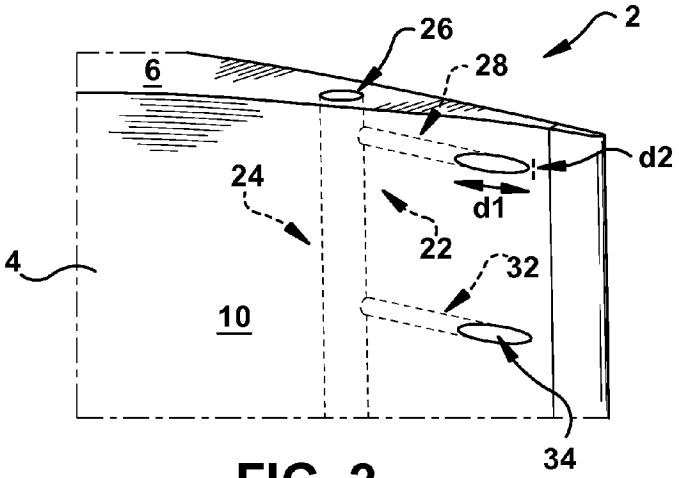
FIG. 2 shows a close-up schematic three-dimensional perspective view of a portion of the turbomachine nozzle of FIG. 1 according to various embodiments of the invention.
Figure 3:
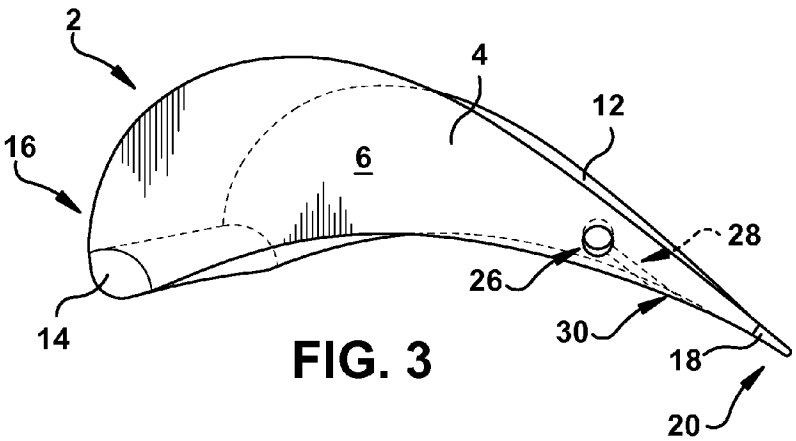
FIG. 3 shows a three-dimensional end view of the turbomachine nozzle of FIGS. 1 and 2 according to various embodiments of the invention.

Turning to FIGS. 1-3, schematic three-dimensional perspective views of a steam turbine nozzle 2 are shown according to various embodiments of the invention. Reference is made to FIGS. 1, 2 and 3 for clarity of illustration. As shown, the steam turbine nozzle 2 includes a body 4. The body 4 can include a first sidewall 6, and a second sidewall 8 opposite the first sidewall 6. The body 4 further includes a pressure side 10 and a suction side 12. Each of the pressure side 10 and the suction side 12 extend between the first sidewall 6 and the second sidewall 8. The body 4 can also include a leading edge section 14 proximate a first portion 16 of the body 4, and a trailing edge section 18 proximate a second portion 20 of the body 4 opposite the first portion 16 of the body 4. As is known in the art, the leading edge section 14 includes a first junction of the pressure side 10 and the suction side 12 of the body 4, while the trailing edge section 18 includes a second junction of the pressure side 10 and the suction side 12 of the body 4. As with conventional nozzles known in the art, the body 4 is designed to direct flow of a working fluid, e.g., steam, from the leading edge section 14, across the pressure side 10, and toward the trailing edge section 18.

In contrast to conventional nozzles, the body 4 further includes a bypass fluid conduit 22. The bypass fluid conduit 22 can include a channel 24 which has an opening 26 to at least one of the first sidewall 6 or the second sidewall 8. The channel 24 is visible through a partially transparent depiction of the body 4 in FIGS. 1-2, but it is understood that the channel 24 does not have an opening on the pressure side 10 or suction side 12 of the body 4. In some embodiments, as shown, the bypass fluid conduit 22 includes an opening 26 to the first sidewall 6 and the second sidewall 8. As will be described further herein, each opening 26 can be located proximate a seal (or, packing) proximate an inner diaphragm ring or an outer diaphragm ring.

Also shown, the bypass fluid conduit 22 can include an outlet passageway 28 that is fluidly connected with the channel 24, between the first sidewall 6 and the second sidewall 8. That is, the outlet passageway 28 can form a continuous flow path with the channel 24, such that a fluid can flow between the channel 24 and the outlet passageway 28. In some cases, the outlet passageway 28 extends substantially perpendicularly from the channel 24, although it is understood that the outlet passageway 28 and the channel 24 could be oriented in a variety of ways to facilitate flow there between. In some cases, the outlet passageway 28 has a lesser length than the channel 24, however, in other cases, the outlet passageway 28 can have a substantially equal or greater length than the channel 24. In any case, the outlet passageway 28 can include a first opening 30 on the pressure side 10 of the body 4. That is, the outlet passageway 28 can terminate at the pressure side 10 of the body 4 allowing a fluid (e.g., leakage fluid) to pass from the opening 26 of the channel 24, through the channel 24 and the outlet passageway 28 to the first opening 30 on the pressure side 10 of the body 4 (e.g., to join with a primary flow path across the pressure side 10 of the body 4).

In some cases, the first opening 30 has a substantially oval shape (shown most clearly in FIG. 2) including a profile that extends a greater distance (d1) between the leading edge 14 and the trailing edge 18 than between the first sidewall 6 and the second sidewall 8. However, it is understood that the first opening 30 could alternately have a rectangular or trapezoid shape in some embodiments. Regardless of its shape (oval, rectangular, trapezoidal, etc.), the first opening 30 can include a profile that extends a greater distance (d1) between the leading edge 14 and the trailing edge 18 than between the first sidewall 6 and the second sidewall 8. In various embodiments, as shown in FIGS. 1 and 2, the bypass fluid conduit 22 further includes a second outlet passageway 32 with a second opening 34 on the pressure side 10 of the body 4. In some cases, the second outlet passageway 32 can have a substantially similar length, shape and/or angle with respect to the channel 24 as the first outlet passageway 28, however, in other cases, the outlet passageways 28, 32 can have distinct lengths, shapes and/or angles. In some cases, the second opening 34 can have a substantially similar shape as the first opening 30, e.g., substantially oval.

In various embodiments of the invention, the channel 24 has a larger inner diameter (IDc) than an inner diameter (IDop1) of the first outlet passageway 28. Similarly, the inner diameter IDc of the channel 24 can be larger than an inner diameter (IDop2) of the second outlet passageway 32.

Figure 4:
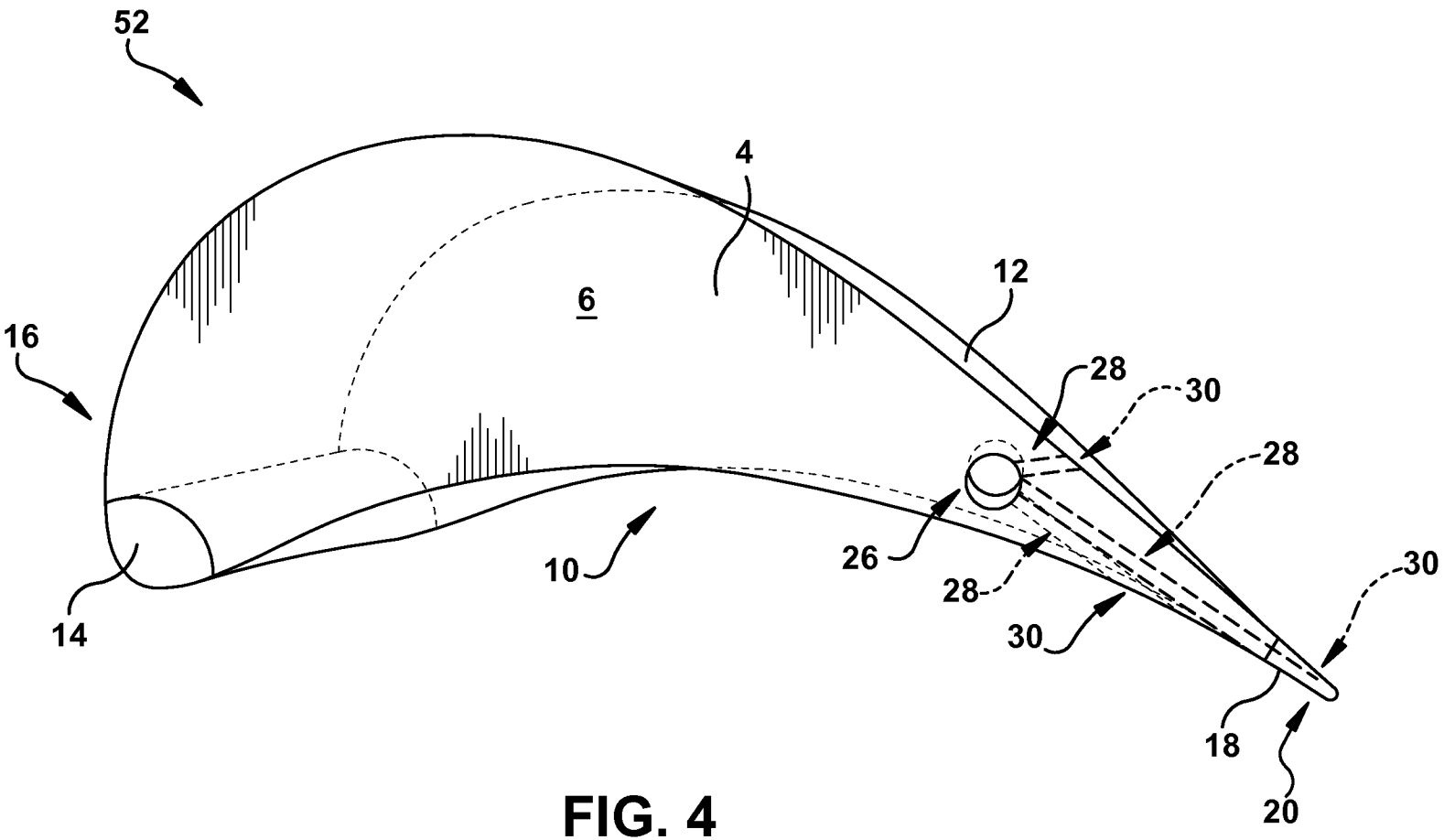
FIG. 4 shows a three-dimensional end view of a turbomachine nozzle according to various alternate embodiments of the invention.

FIG. 4 shows a three-dimensional end view of a turbomachine nozzle blade 52 according to various alternate embodiments of the invention. As shown by common numbering, several features of the nozzle blade 52 are similar to those shown and described with reference to the nozzle blade 2 of FIGS. 1-3. However, the nozzle blade 52 of FIG. 4 illustrates alternate embodiments in which one or more outlet passageways 28 are shown fluidly connected with the bypass fluid conduit 22 and at least one of the pressure side 10 of the body 4, the suction side 12 of the body 4 or the trailing edge section 18 of the body (shown in phantom as optional configurations). In some cases, the nozzle blade 52 can include a plurality of outlet passageways 28 extending from the bypass fluid conduit 22, where at least two of those outlet passageways 28 have openings 30 on a different surface of the body 4 (e.g., the suction side 12 and pressure side 10, or pressure side 10 and trailing edge section 18, etc.).

Figure 5:
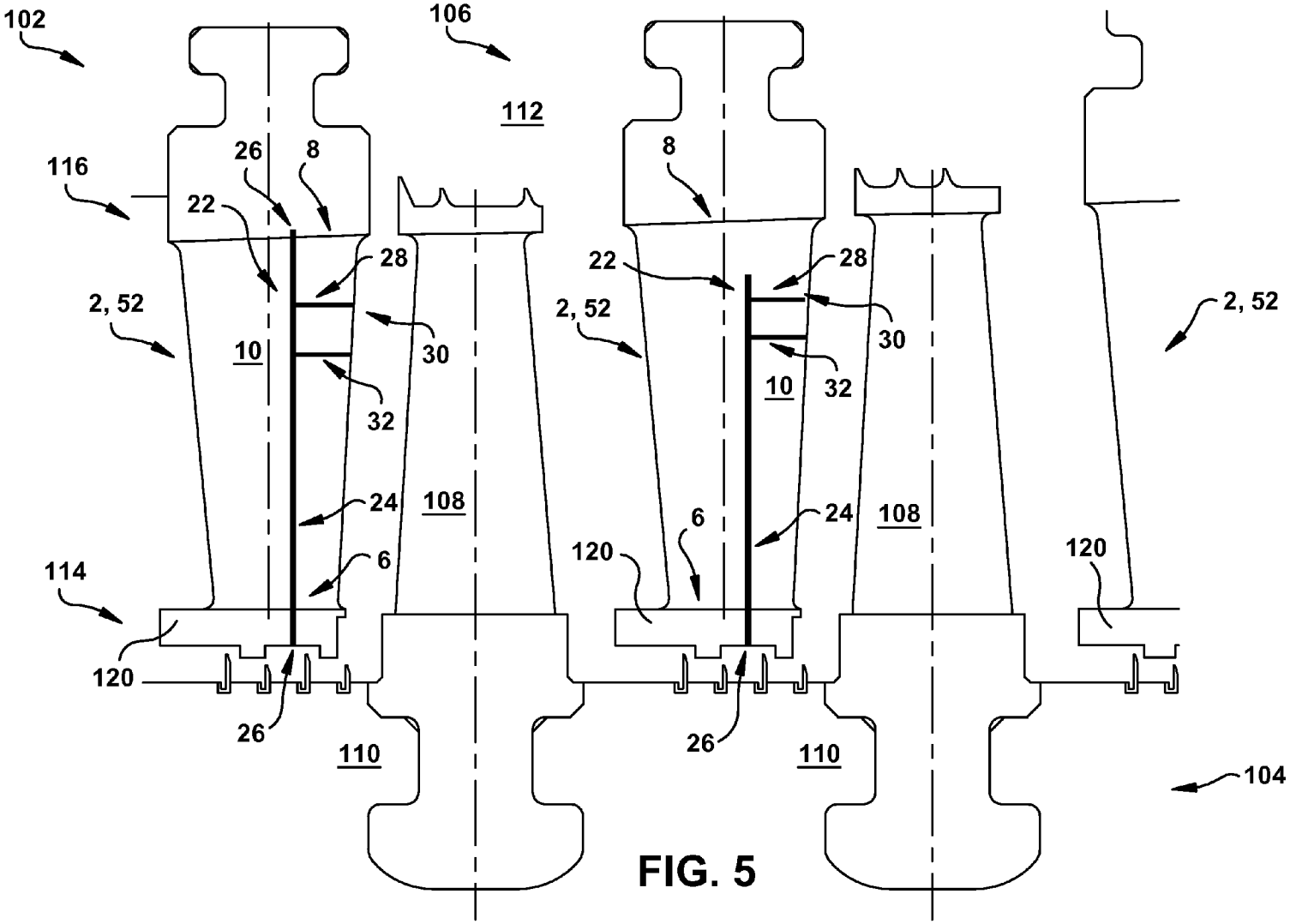
FIG. 5 shows a schematic cross-sectional view of a portion of a turbomachine according to various embodiments of the invention.

FIG. 5 shows a cross-sectional schematic view of a portion of a turbomachine 102 including a rotor section 104 and a stator section 106 substantially housing the rotor section 104. As shown, and as is known in the art, the rotor section 104 can include a set of buckets 108 (each bucket 108 representing a stage of buckets arranged circumferentially about the rotor body 110) which are coupled to the rotor body 110. The stator section 106 can include a diaphragm 112, which has an inner diaphragm ring 114 and an outer diaphragm ring 116. Spanning between the inner diaphragm ring 114 and the outer diaphragm ring 116 are a set of nozzle blades 2 (each nozzle blade 2 representing a stage of nozzle blades arranged circumferentially between the inner diaphragm ring 114 and the outer diaphragm ring 116), such as the nozzle blades 2 and/or 52 shown and described with reference to FIGS. 1-4. Also shown are packing sections (or, seals) 120, which are located at the radially inner ends of the blades 2, proximate the sidewall (e.g., first sidewall 6). As shown, at least one of the blades 2 can include a bypass fluid conduit 24 extending substantially radially from the first sidewall 6, with a channel 24 and an outlet passageway 28 fluidly connecting the opening of the conduit 22 at the sidewall 6 with the pressure side 10 of the body 4 of the blade 2, 52. In some cases, the channel 24 includes an opening at only one sidewall, e.g., the first sidewall 6, but in other cases, the channel 24 includes openings 26 at both sidewalls 6, 8 of the body 4.

In various embodiments of the invention, the bypass fluid conduit 22 is configured to divert a fluid (e.g., a leakage fluid such as steam or condensate) from the packing section 120 to the first opening 30 on the pressure side 10 of the body 4 during operation of the turbomachine 102. In some cases, where the bypass fluid conduit 22 includes more than one outlet passageway 28, 32, and the fluid flow is sufficient, the bypass fluid conduit 22 is configured to divert the fluid to each of the first opening 32 and the second opening 34 on the pressure side 10 of the body 4. It is understood that in alternate embodiments, the bypass fluid conduit 22 can include one or more outlet passageways 28, 32, which open to the suction side 12 of the blade (e.g., blade 52) and/or the trailing edge section 18. In any case, the bypass fluid conduit 22 is configured to divert the fluid (e.g., leakage fluid such as steam or condensate) from the packing section 120 to at least one of the openings 30 on the pressure side 10, suction side 12 and/or trailing edge section 18.

As described herein, various embodiments of the invention include a turbine nozzle design which allows for introduction of leakage fluid flow into the primary flow path of the turbine. The nozzle includes a conduit which is fluidly connected with a leakage fluid source such as a packing or seal that traditionally traps and routes leakage fluid. In the designs shown and described herein, this leakage fluid is joined with the primary working fluid to increase the efficiency of the overall turbine, thereby alleviating leakage flow related performance losses associated with conventional systems that do not utilize the nozzles disclosed according to various embodiments of the invention.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A turbomachine comprising:

a rotor section; and a stator section substantially housing the rotor section, the stator section including:

a packing section; and a set of static nozzles spanning between an inner diaphragm ring and an outer diaphragm ring, wherein at least one static nozzle in the set of static nozzles includes:

a body having:

a first sidewall and a second sidewall opposite the first sidewall; and a pressure side and a suction side each extending between the first sidewall and the second sidewall; and a bypass fluid conduit including:

a channel having an opening to each of the first sidewall and the second sidewall, the channel extending through the packing section; and an outlet passageway fluidly connected with the channel between the first sidewall and the second sidewall, the outlet passageway including a first opening on the pressure side of the body, wherein the bypass fluid conduit is configured to divert a fluid from the packing section to the first opening on the pressure side of the body during operation of the turbomachine.

2. The turbomachine of claim 1, wherein the at least one static nozzle further includes:

a leading edge section proximate a first portion of the body; and a trailing edge section proximate a second portion of the body opposite the first portion of the body.

3. The turbomachine of claim 2, wherein the first opening has a substantially oval, rectangular or trapezoidal shape including a profile that extends a greater distance between the leading edge and the trailing edge than between the first sidewall and the second sidewall.

4. The turbomachine of claim 1, wherein the bypass fluid conduit further includes at least one additional outlet passageway each with an additional opening on the suction side of the body or the trailing edge section.

5. The turbomachine of claim 1, wherein the channel has a larger inner diameter than an inner diameter of the outlet passageway.

6. The turbomachine of claim 1, wherein the channel extends entirely radially through the body between the opening on the first sidewall and the opening on the second sidewall.

* * * * *